United States Patent [19]

Inaba et al.

[11] Patent Number: 4,553,640

[45] Date of Patent: Nov. 19, 1985

[54] CONTROLLER FOR ELEVATOR

[75] Inventors: Hiromi Inaba; Seiya Shima, both of Katsuta; Takeki Ando, Naka; Toshiaki Kurosawa, Katsuta; Yasunori Katayama, Hitachi; Takanobu Hatakeyama; Sadao Hokari, both of Katsuta, all of Japan

[73] Assignee: Hitachi, Ltd., Tokyo, Japan

[21] Appl. No.: 413,820

[22] Filed: Sep. 1, 1982

[30] Foreign Application Priority Data

Sep. 4, 1981 [JP] Japan ..... 56-138448

[51] Int. Cl.[4] ..... B66B 1/28

[52] U.S. Cl. ..... 187/29 R

[58] Field of Search ..... 187/29

[56] References Cited

U.S. PATENT DOCUMENTS

| | | | |
|---|---|---|---|
| 3,507,360 | 4/1970 | Ostrander et al. | 187/29 |
| 3,523,232 | 8/1970 | Hall et al. | 187/29 |
| 4,128,142 | 12/1978 | Satoh et al. | 187/29 |
| 4,161,235 | 7/1979 | Caputo et al. | 187/29 |
| 4,319,665 | 3/1982 | Komuro et al. | 187/29 |
| 4,354,577 | 10/1982 | Yonemoto | 187/29 |

FOREIGN PATENT DOCUMENTS

| | | | |
|---|---|---|---|
| 1526369 | 9/1978 | United Kingdom | 187/29 |

*Primary Examiner*—William M. Shoop, Jr.
*Assistant Examiner*—W. E. Duncanson, Jr.
*Attorney, Agent, or Firm*—Antonelli, Terry & Wands

[57] ABSTRACT

An elevator controller which uses an acceleration command signal that has as its initial value a start shock compensation torque which will offset the unbalance torque caused at the time of starting. From the completion of elevator car acceleration to the start of deceleration, the acceleration command is gradually increased or decreased to control the motor so as to provide a smoother motion of the car. After the inception of the car deceleration a velocity command is issued which decreases with the reducing distance between the car and the destination floor.

18 Claims, 23 Drawing Figures

CONTROLLER FOR ELEVATOR

BACKGROUND OF THE INVENTION

The present invention relates to an elevator controller. The elevator is a vehicle which is required to operate in such a way as to not cause uncomfortableness or uneasiness to the passengers, not to mention a very great requirement for safety.

One known method of controlling a motor that drives an elevator controls the field current of the motor in both directions and the armature current in one direction according to the difference between the velocity command and the actual speed. Another known method controls the field current in one direction and the armature current in both directions.

The U.S. Pat. No. 4,099,111 employs the former control method whereby a substantial improvement in comfort in the ride is obtained by realizing a highly linear motor torque characteristic which provides a smooth transition in the velocity command.

The latter control method is employed in the systems disclosed in U.S. Pat. No. 4,171,505 and U.S. Pat. No. 4,263,988. These systems attain an improvement in safety by detecting and reducing abnormal speed and provides comfort in the ride by using a smooth transition in the velocity command.

In this way, either method uses a smooth transition in the velocity command and improves the response to the velocity command by the speed feedback control so as to obtain a desired level of comfort and control performance.

Generally, an elevator is constructed so that a car and a counterweight are connected by a rope hung on a drive sheave which is driven by a motor. The weight of the counterweight is so set to balance the car when the car is filled 40% to 50% to capacity. Thus, depending on the weight of the passengers in the car, an imbalance torque may result. For example, when the weight of the passengers is 10% of the full load an upward imbalance torque acts on the motor. When the car is 90% full, a downward imbalance torque acts on the motor. This means that the response to the velocity command varies according to the passengers weight, resulting in an overshoot in the elevator velocity and vibration, causing discomfort to the passengers in the car.

A method (called a start compensation system) is known in which before releasing the electromagnetic brake to move the car, the passenger load is detected to produce a torque in the motor which will offset the imbalance torque.

While the use of the start shock compensation system alleviates the vibration due to the imbalance torque caused when the mechanical brake is released, the variation in the elevator response to the velocity command during acceleration cannot be avoided. Because of the accuracy of the load detecting device, it is difficult to provide an adequate start shock compensation. Thus, even with the start shock compensation system the conventional elevator controller cannot provide a desired level of smoothness in car motion.

The comfort the passengers feel during the operation of an elevator is considered to be affected when the elevator starts or stops accelerating or decelerating or when the acceleration changes, and the characteristic relating to the comfort depends on the velocity of the elevator. Hence, to improve the passengers' comfort it is necessary to provide a velocity command for each different speed. With a high-speed elevator it is required to prepare a large number of velocity commands because it has many operating speeds.

SUMMARY OF THE INVENTION

The first object of this invention is to provide an elevator controller that can provide an improved comfort to passengers in the elevator car.

The second object of this invention is to provide an elevator controller that, in addition to providing an improved comfort during operation, can stop with high accuracy at a level flush with a floor.

The first feature of this invention is the use of an acceleration command, in addition to the velocity command conventionally used to control the elevator driving motor, so that the motion of the elevator that passengers can feel is directly controlled.

The second feature of this invention is the combined use of the acceleration setting control and the speed feedback control so that these two controls are selectively changed over according to the elevator operation range to make the motion of the elevator comfortable to the passengers.

Other objects and features of this invention will be detailed in the following example embodiments.

BRIEF DESCRIPTION OF THE DRAWINGS

FIG. 4 is a flowchart of a start shock compensation mode program;

FIG. 5 is a flowchart of an acceleration start mode program;

FIG. 6 is an acceleration characteristic of the elevator, (A) showing the characteristic of a conventional elevator and (B) showing the characteristic of this invention;

FIG. 7 is an operation characteristic for the conventional elevator using the velocity command;

FIG. 8 is a flowchart for a constant acceleration mode program;

FIG. 9 is a flowchart for an acceleration reduction mode program;

FIG. 10 is an operation characteristic for explaining FIG. 9;

FIG. 11 is a flowchart for an acceleration reduce mode program;

FIG. 12 is a flowchart for a constant velocity travel mode program;

FIG. 13 is a flowchart for a deceleration increase mode program;

FIG. 14 is a flowchart for an acceleration end mode program;

FIG. 15 is a flowchart for a rated travelling mode program;

FIG. 16 is a flowchart for a deceleration start mode program;

FIG. 17 is a flowchart for a constant deceleration mode program;

FIG. 18 is an diagram for explaining the deceleration setting characteristic;

FIG. 19 is a flowchart for a deceleration reduction mode program;

FIG. 20 is a flowchart for a micro landing operation mode program; and

FIG. 21 is a flowchart for a rope elongation and micro landing operation mode program.

DESCRIPTION OF THE PREFERRED EMBODIMENT

Figure 1:
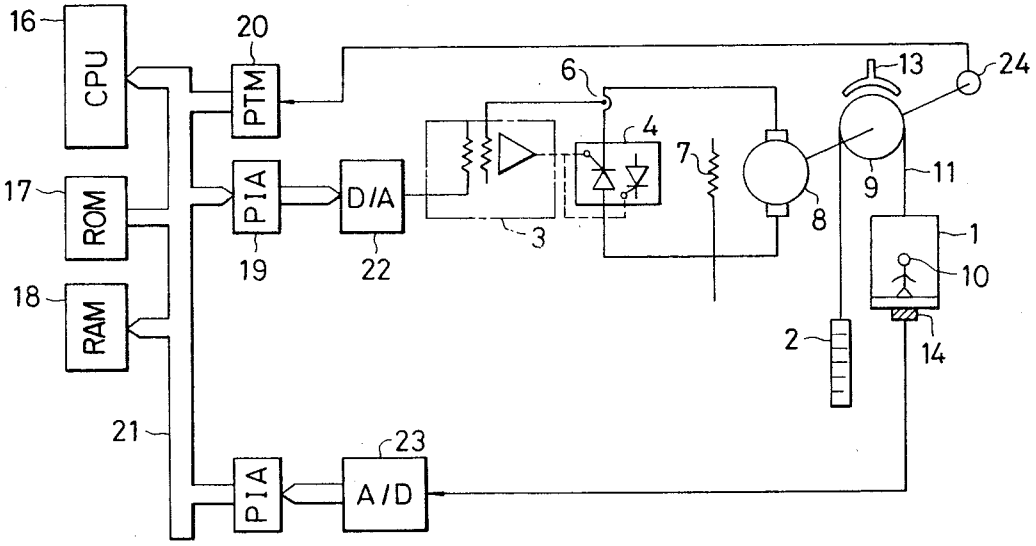
FIG. 1 is a schematic diagram showing an overall construction of the elevator controller according to this invention.

FIG. 1 is a schematic diagram showing the entire construction of the elevator controller of this invention. A direct current elevator is taken as an example in which the armature current is controlled in both positive and negative directions and the field current is controlled in one direction only and which uses a microcomputer in the logic controller. It will become apparent that the invention can also be realized by using a wired logic such as an IC or relays in the logic controller that controls the field current in both positive and negative directions.

In FIG. 1, a rope 11 is hung on the sheave 9 with an elevator car 1 and a counterweight 2 attached to each end of the rope. A phase shifter 3 compares the current setting and the armature current from current detector 6 to generate a firing signal for the group of thyristor bridges 4 connected in anti-parallel. The field winding 7 is excited in a manner already known and the armature 8 is controlled by the phase shifter 3 to drive the sheave 9. The sheave 9 in turn lifts or lowers the elevator car 1 carrying passengers 10. Denoted at 13 is a mechanical brake and at 14 a load detector for detecting the weight of passengers 10.

The logic controller is formed of a known microcomputer in which reference numeral 16 represents a microprocessor (CPU) for performing arithmetic operations, 17 a read-only memory (ROM) in which a sequence of CPU operations is stored, 18 a random access memory (RAM) which provides a temporary storage as a working area for CPU, 19 a peripheral interface adaptor (PIA) for interfacing the CPU with external digital signals, 20 a programmable timer module (PTM) for detecting acceleration and velocity of the elevator by counting the output pulses from a rotary encoder 24, 21 a bus through which address and data are transferred, 22 a digital-to-analog) (D/A) convertor for converting digital signal into analog signal, 23 an analog-to-digital (A/D) convertor for converting analog signal into digital signal, and 24 a rotary encoder (pulse generator) for generating pulses according to the distance the car traveled.

Figure 2:
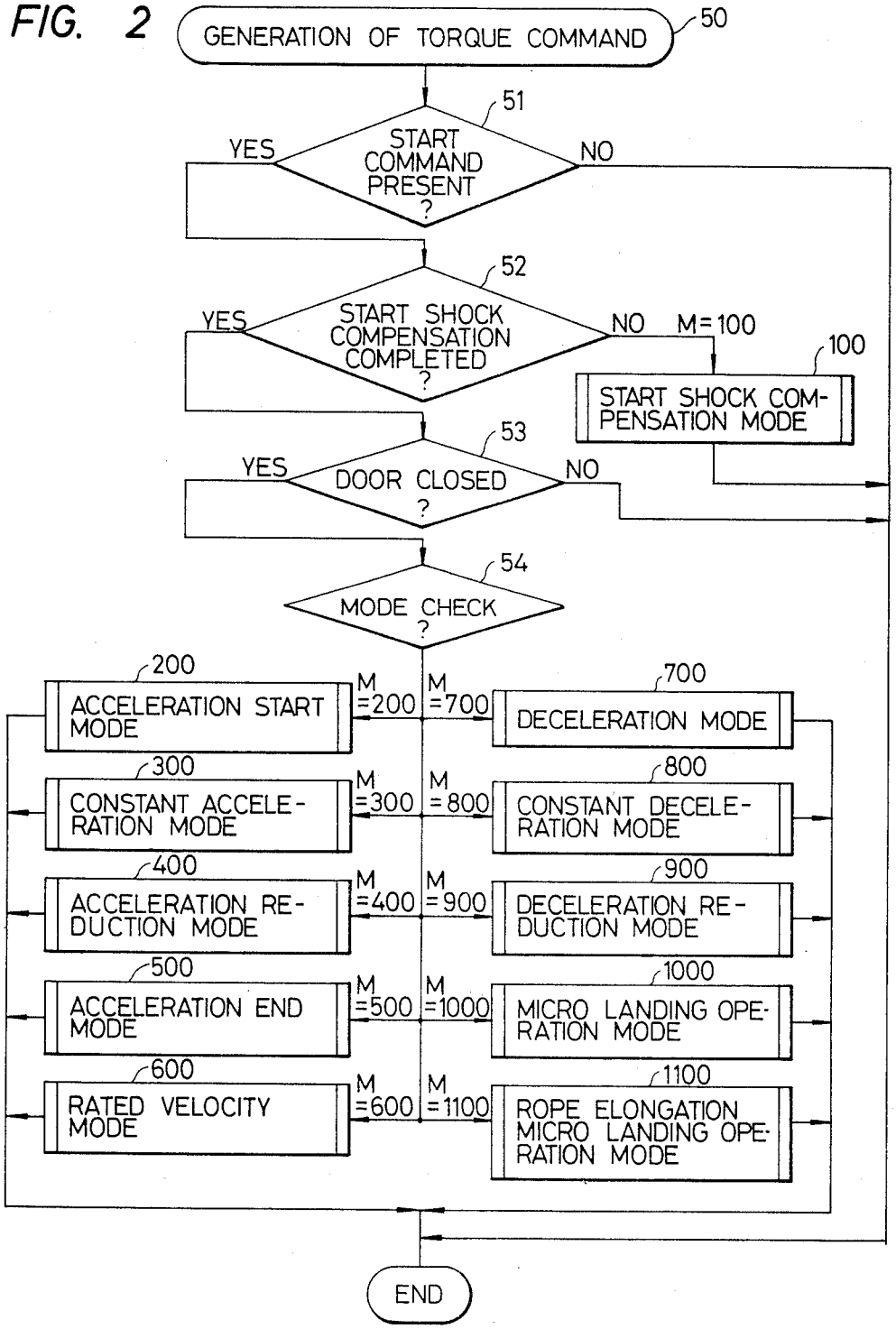
FIG. 2 is a flowchart explaining the program for generating the elevator torque setting signal, which constitutes the feature of this invention.

In this circuitry the program that realizes the control of this invention is stored in ROM 17. The overall structure of the program is shown in FIG. 2. The program having the function as shown in FIG. 2 generates a torque command signal which changes according to the elevator operating condition.

The torque command signal generating program 50 is started by a hardware timer interrupt (not shown) at regular intervals after the microcomputer power is turned on or the microcomputer is restarted. When initiated, this program first checks for the presence of the elevator start command at step 51. If the start command is not present, the program will come to an end. If the command is found, the program checks at step 52 whether the start shock compensating action is completed. If found not completed, the start shock compensating mode 100 will be executed. If this compensating action is found completed, the program checks at step 53 if the door closing action is completed. When the door closing action is found not completed, the program will come to an end. When the door is found closed, the program proceeds to check the torque command signal generating mode at step 54 and executes one of the following modes: acceleration start mode 200, constant acceleration mode 300, acceleration reduction mode 400, acceleration ending mode 500, rated velocity mode 600, deceleration start mode 700, constant deceleration mode 800, deceleration reduction mode 900, micro landing operation mode 1000 and rope elongation and micro landing operation mode 1100. The mode check is done according to a certain "condition" (that is, the program, seeing the value M (either 100, 200, . . . , 1100) stored, will jump to a subroutine to be described later and return to the main program). According to the motion of the elevator, each mode can be initiated within an equal response time. That is, there will be no large variation in time which it takes for the various torque command signals to be generated after the program was started. This enables the main program 50 to generate of torque command which have constant rate of change of acceleration. For other tasks at the same level of the main program 50 such as velocity detection and acceleration detection programs, this will prevent variation in the arithmetic operation result.

Figure 3:
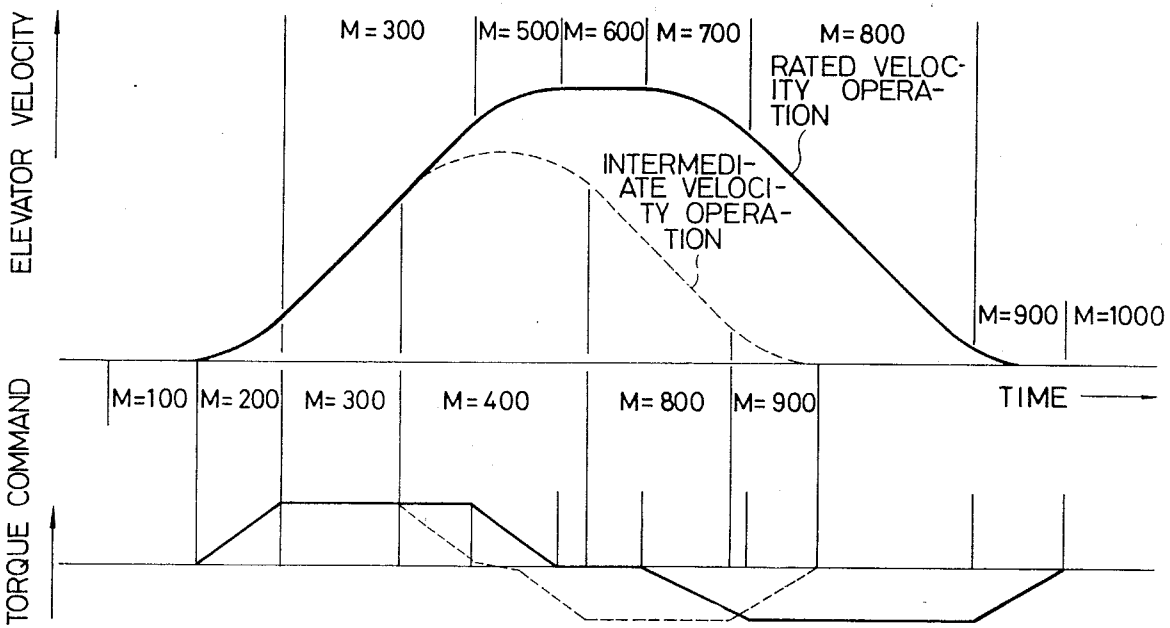
FIG. 3 is an elevator operation characteristics that explains the overall operation of this invention.

FIG. 3 shows how the start shock compensation mode 100 through the microlanding operation mode 1000 are selected according to the elevator motion during the rate velocity operation and during the intermediate velocity operation (i.e., when the elevator velocity does not reach the rated velocity, as indicated by the dashed line.) The elevator velocity is shown at the upper portion of FIG. 3 and, at the lower portion, the acceleration command (=torque command) output according to this invention is shown.

Now, the sequence of actions each mode performs will be explained in the following.

Figure 4:
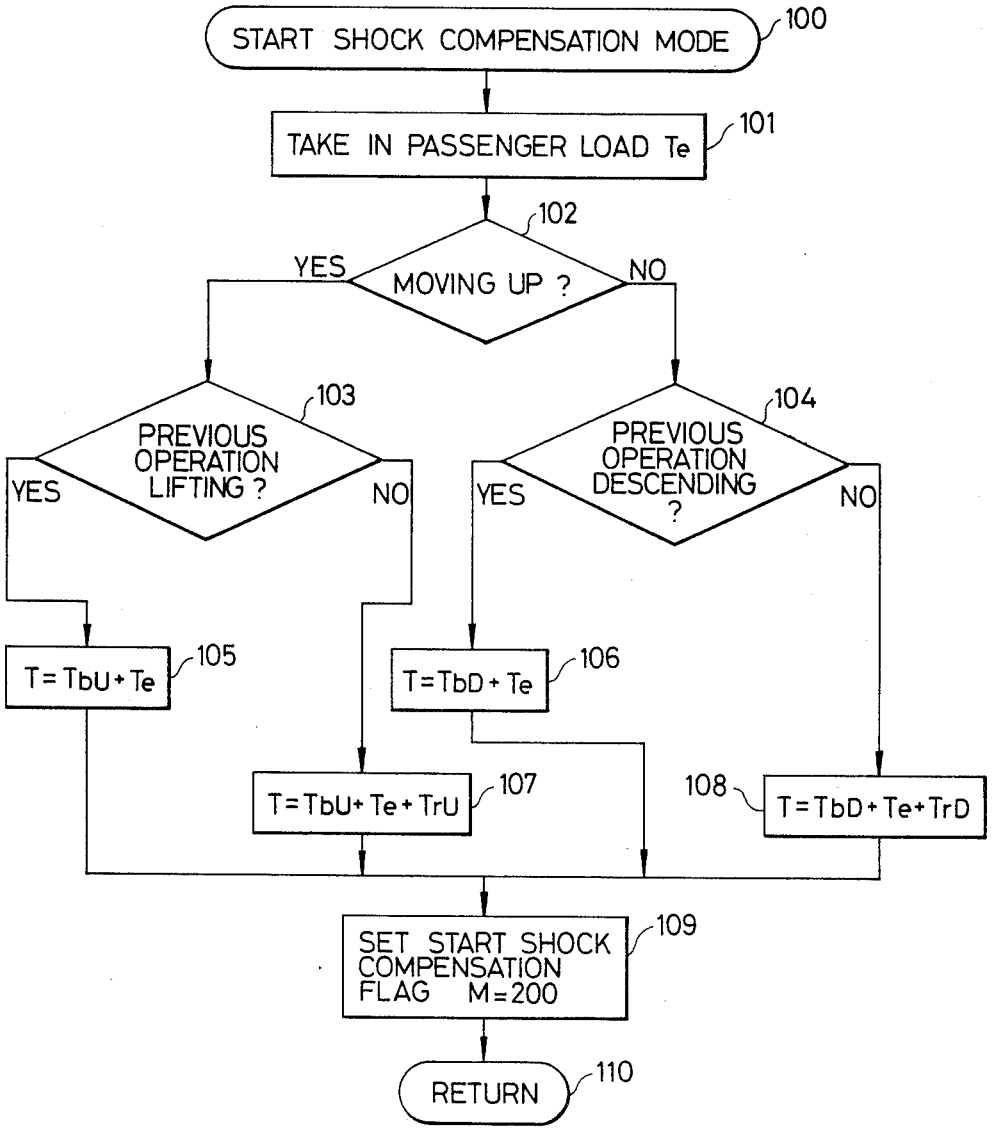
FIGS. 4 through 21 are flowcharts and diagrams giving a detailed explanation of one embodiment of this invention.

The start shock compensation mode 100, as shown in FIG. 4, consists of a step 10 to take in a passenger load Te, steps 102 through 108 to calculate the torque command T, and a step 109 to a set a flag indicating the start shock compensation is completed. The calculation of the torque command T is performed in the following sequence. At step 102 a check is made as to whether the current elevator motion is upward or downward and steps 103 and 104 determine whether the current operation is in the same direction, upward or downward, as the previous elevator operation. Then a torque command T is calculated at steps 105 through 108 for each travel direction and depending on whether the travel direction is reversed or not. For example, when the current travel direction is upward and the same as the previous operation direction, in other words, when the elevator car that was moving upward stopped at a certain floor and is restarted to move up, the step 105 is executed to obtain the torque command T which is the sum of the upward travel bias TbU and the passenger weight Te. Likewise, when the car that was descending stopped and is restarted to move up, a step 107 is executed. The torque command T for this case is the above command value to which is added a compensation value Tru. TbD is a descending bias and TrD is a compensating value used for the case where the car that was ascending stopped and restarted to move down.

When the reverse operation compensation is omitted from steps 103, 104, 107 and 108, a small starting shock may result but it is not a serious problem. The start shock compensating mode 100 has only to be performed once before starting, so that a single pass condition is set up at step 109.

Figure 5:
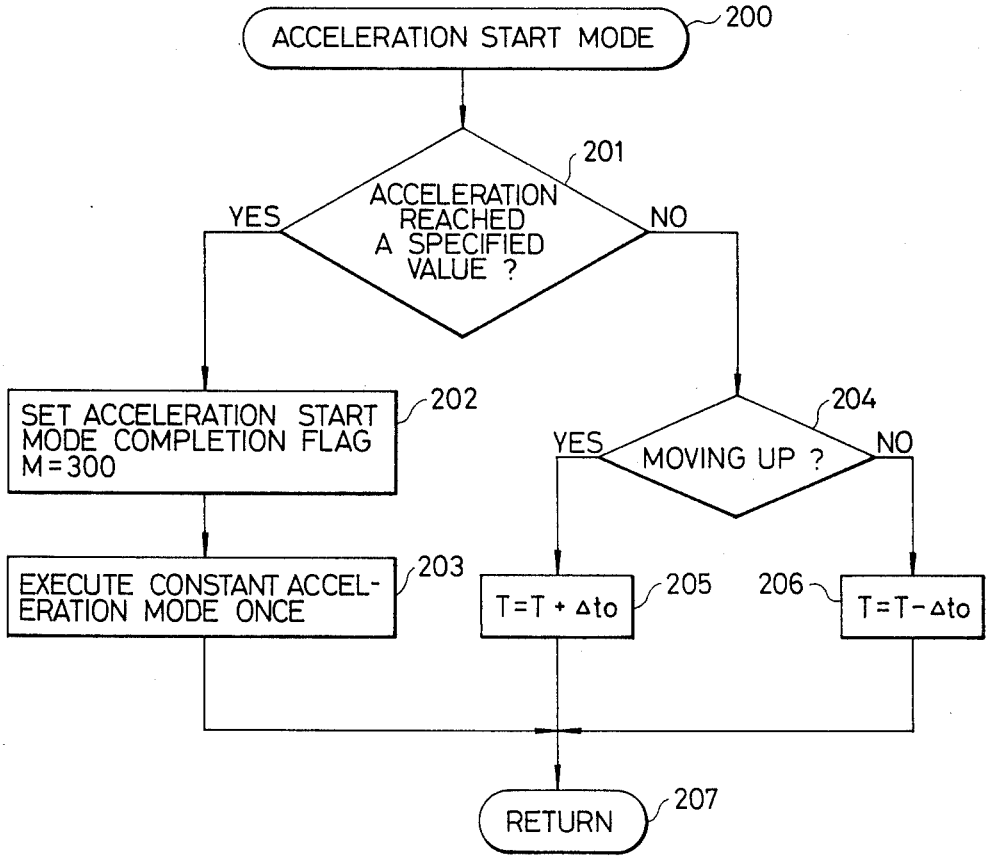

The acceleration start mode 200, as shown in FIG. 5, performs a check at step 201 as to whether the elevator acceleration A obtained from another known program (not shown) has reached a specified value. If so, a flag is set at step 202 indicating the completion of the acceleration start mode. At step 203 a constant acceleration mode to be described later is executed once bringing the acceleration start mode 200 to an end. The reason to perform the step 203 is that since the torque command signal generating program 50 is started by the timer interrupt at regular intervals, if during the time interval between the completion of the acceleration start mode and the first execution of the constant acceleration mode, only the acceleration start mode completion flag setting were performed and no new torque command signal were produced, then there would be a delay of one cycle before the torque command appears.

However, if the intervals between the time interrupts are made very short, the step 203 can be omitted. When the elevator acceleration A has not yet reached the specified value, a check is made at step 204 on whether the car is moving up or down. If the car is found to be moving up, at step 205 the previous torque command T is added to a specified value $\Delta t_0$ to give a new torque command T. If the car is found moving down, the step 206 subtracts the value $\Delta t_0$ from the previous torque command T to produce a new torque command T. In this way the elevator acceleration is controlled. The specified value $\Delta t_0$ used in the torque command generation steps 205 and 206 is determined so that a desired rate of change of acceleration is obtained, considering the intervals at which the program 50 is run.

The initial value of torque command T used at the steps 205 and 206 when the acceleration start mode 200 is first executed is the value obtained from the steps 105 through 108 of the start shock compensation mode 100. This ensures a smooth, continuous torque transition from the start shock compensation mode 100 to the acceleration start mode 200.

Therefore, the operation characteristic during acceleration is improved over the conventional one, as shown in FIG. 6.

Figure 6A:
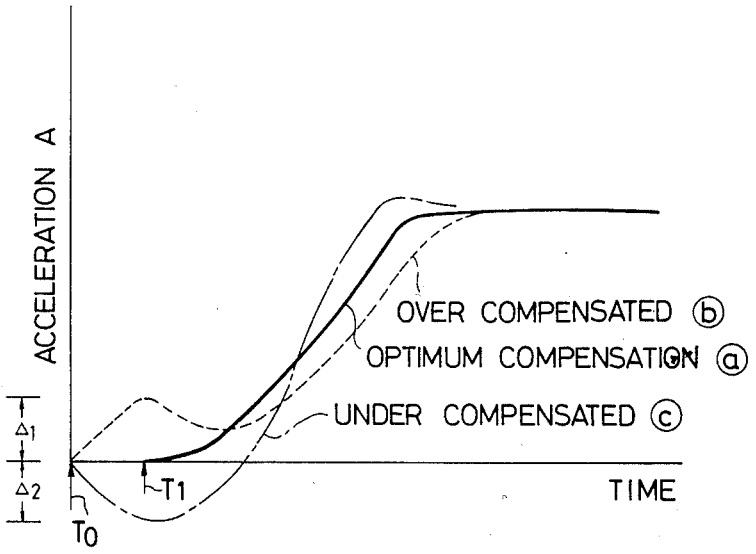
Figure 6B:
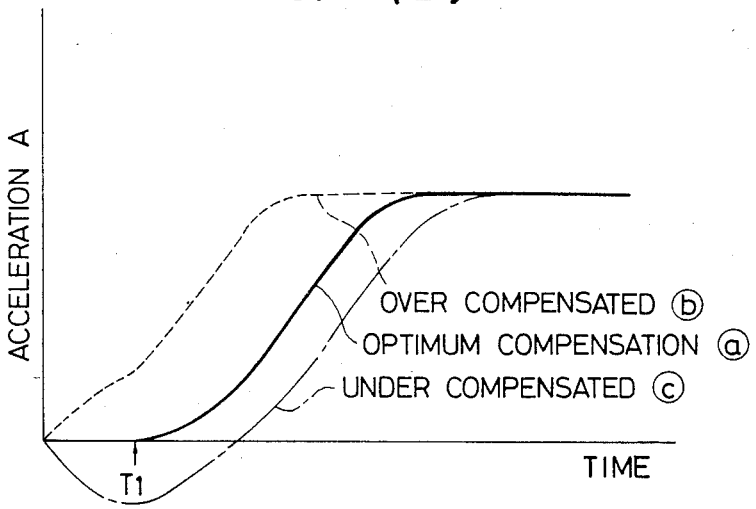

FIG. 6 represents the case where the elevator is moving up, with an ordinate indicating the acceleration and an abscissa the time that elapsed after the elevator started. FIG. 6(A) shows the characteristic of the conventional elevator and FIG. 6(B) that of the present invention.

As shown by curves b and c of FIG. 6(A), when the start shock compensation is not appropriate, this effect will be felt during the acceleration starting period. The start shock compensation is activated before the mechanical brake 13 is released at $T=T_0$. If the start shock compensation is not adequate, the velocity control system will operate during the time after the mechanical brake is opened at $T=T_0$ until the velocity command begins to increase gradually at $T=T_1$ even though the velocity command is zero during this period. The velocity difference during this period is integrated. When undercompensated the control system will cause the car to be accelerated as shown by the curve c and, when over-compensated, cause the car to be decelerated as shown by the curve b. Combined with the delay of control system response, the undercompensation c will result in an acceleration overshoot and the overcompensation b will result in fluctuation in acceleration. The possible cause of this phenomena is considered as arising from the fact that the torque control during the start shock compensation period is different in quality from the velocity control using a speed command and that these two controls of different nature operate one after another without interval.

On the contrary the present invention employs an acceleration command to directly control the motor torque thereby making the torque control similar in nature to the start shock compensation. Therefore, when the start shock compensation is not adequate as shown in FIG. 6(B), that is, when undercompensation c or overcompensation b occurs, the velocity of the car is controlled in accordance with the gradually increasing acceleration command after $T=T_1$ with the result that no bad effect of inadequate start shock compensation will appear during the acceleration start period. That is, as shown in FIG. 6(B), no overshoot or pulsation will result assuring smooth acceleration.

Conventional elevator controllers give an integral characteristic to the comparator for comparing the velocity command and the actual velocity in order to make the velocity difference due to load variation equal to zero. However, should there be a case where passengers in excess of nominal passenger load capacity are carried upward, a command greater than the thyristor saturating level would be input to the comparator. This will render the shaded region of the comparator output eg as seen in FIG. 7, uncontrollable and thereby causes a delay in the reduction of current d by the period Δ 3 at the end of acceleration, resulting in the elevator velocity h overshooting from the command g.

Figure 7:
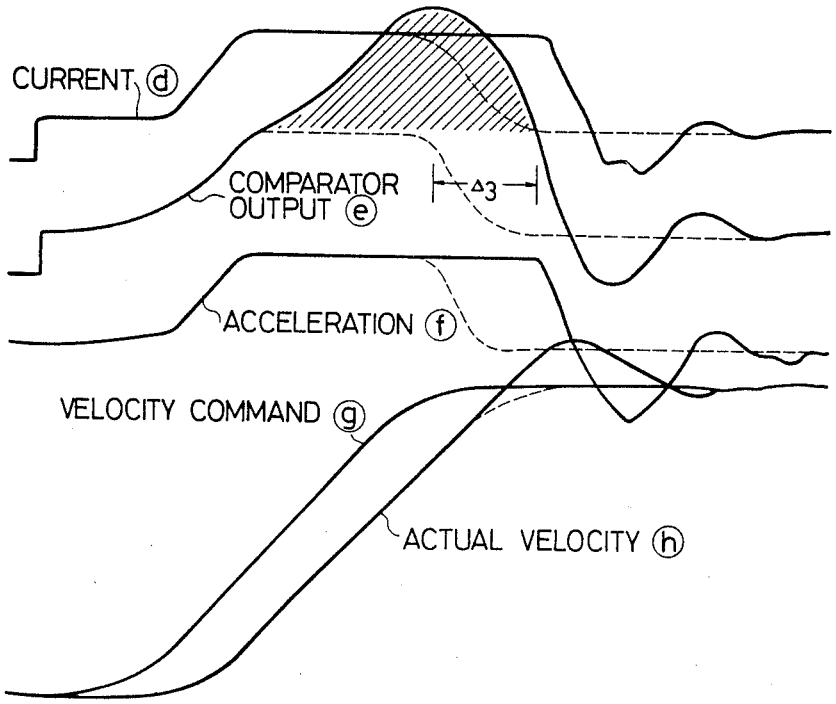

To eliminate this drawback, the comparator output e may be clipped near the current controller saturating point or the comparator output adjusted beforehand to provide the comparator output characteristic as shown by the dotted line in FIG. 7. This is not practical, however, because the number of elevators ordered in a single purchase is very limited and the type is wideranging. This problem can be overcome with this invention.

The acceleration start mode 200 in the above embodiment is not provided beforehand with a torque command as a predetermined pattern but calculates it each time the program is started. This reduces the required capacity of the RAM in which intermediate results are stored and also enables application of this invention to the case where a plurality of elevators are operated at low acceleration and deceleration by an emergency power source such as an independent power plant. The torque command signal generators 205 and 206 perform an estimate control with no feedback so as to shorten the process time.

Figure 8:
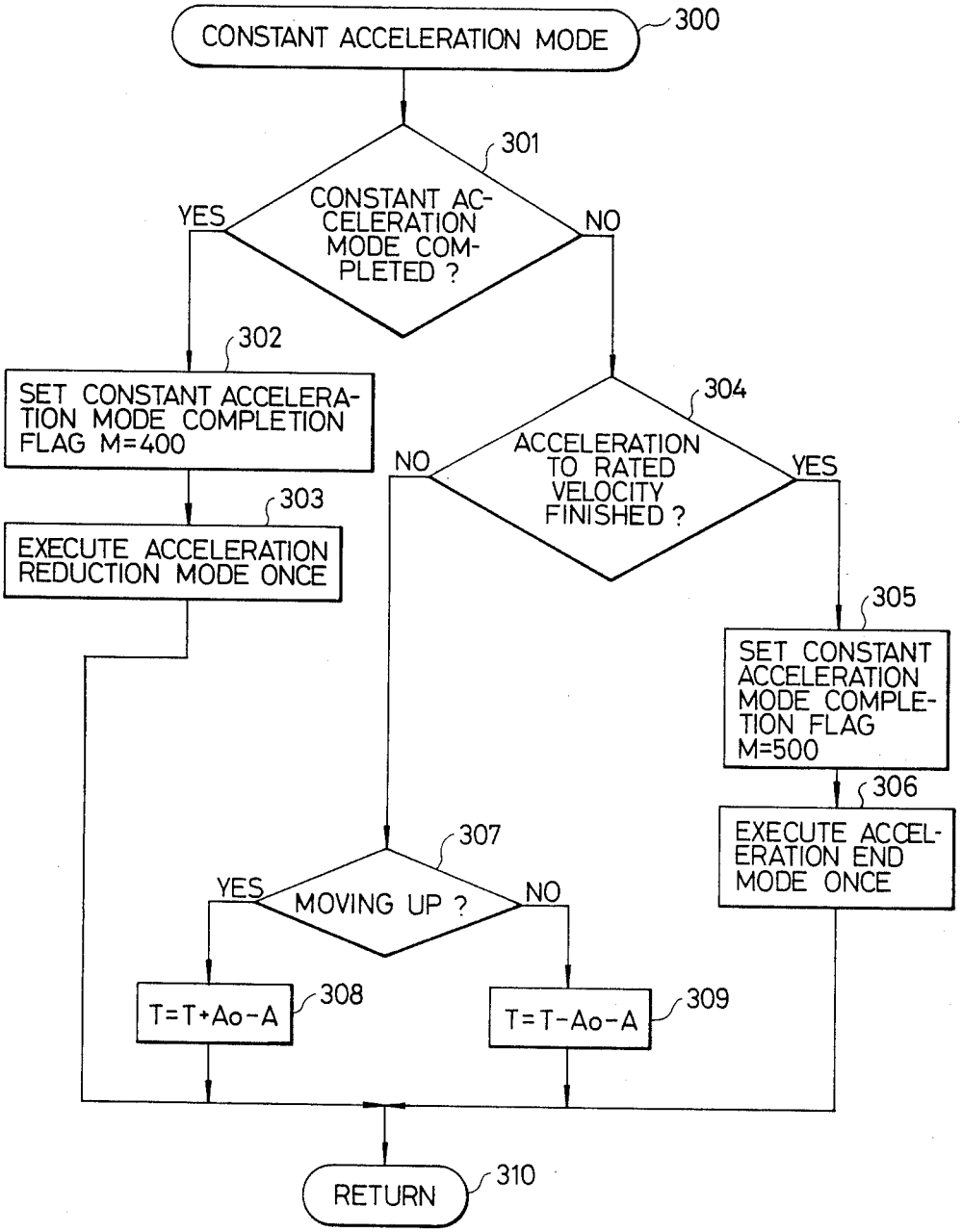

Next, the constant acceleration mode 300 is explained referring to FIG. 8. This mode first checks at step 301 whether the constant acceleration mode has been completed. The check is made by determining if the difference between the velocity setting $V_1$ and the actual elevator velocity $V_2$ becomes smaller than a specified value V4.

The velocity command V1 is obtained from $$V_1=2\cdot A_1\cdot(L-\Delta L)$$

where L represents the distance between the car and the floor at which the car is scheduled to stop, $\Delta L$ a value used to calculate the second velocity command, and $A_1$ a specified deceleration $A_1$. The calculation of $V_1$ is performed by a separate program (not shown). The calculation of the square root may be done by a dedicated arithmetic IC or a square root table may be stored beforehand in the ROM 17 to obtain an approximate value using interpolation.

The velocity of the elevator $V_2$ is determined from the pulse counts generated by the rotary encoder 24 shown in FIG. 1 in a manner already known.

When the constant acceleration mode is found to be completed, the mode completion flag is set at step 302 and then at step 303 the acceleration reduction mode which will follow the current mode is executed once before bringing the current mode to an end. When the constant acceleration mode is found not to be completed, a step 304 checks whether the acceleration has produced the rated velocity. If so, a flag is set at step 305 indicating the constant acceleration mode is finished. Then at step 306 the acceleration end mode which will follow the current mode is executed once before bringing the current mode to an end. The decision at step 304 on as to whether the acceleration has produced the rated velocity is made by checking if the difference between the elevator rated velocity $V_3$ and the actual elevator velocity $V_2$ is smaller than a specified value $V_5$. If the acceleration to the rated velocity is not yet completed, a step 307 makes a decision on whether the car is moving upward. If the car is found moving up, at step 308 a new torque command T is calculated from the previous torque command T, a specified acceleration $A_0$ and the elevator acceleration A. For descending, a similar operation is performed at step 309 to obtain a torque command. In either step 308 or 309, the value T on the right-hand side uses the previous torque command and when this mode is performed for the first time the last value of the preceding mode (which corresponds to the acceleration start mode) is used as an initial value.

Figure 9:
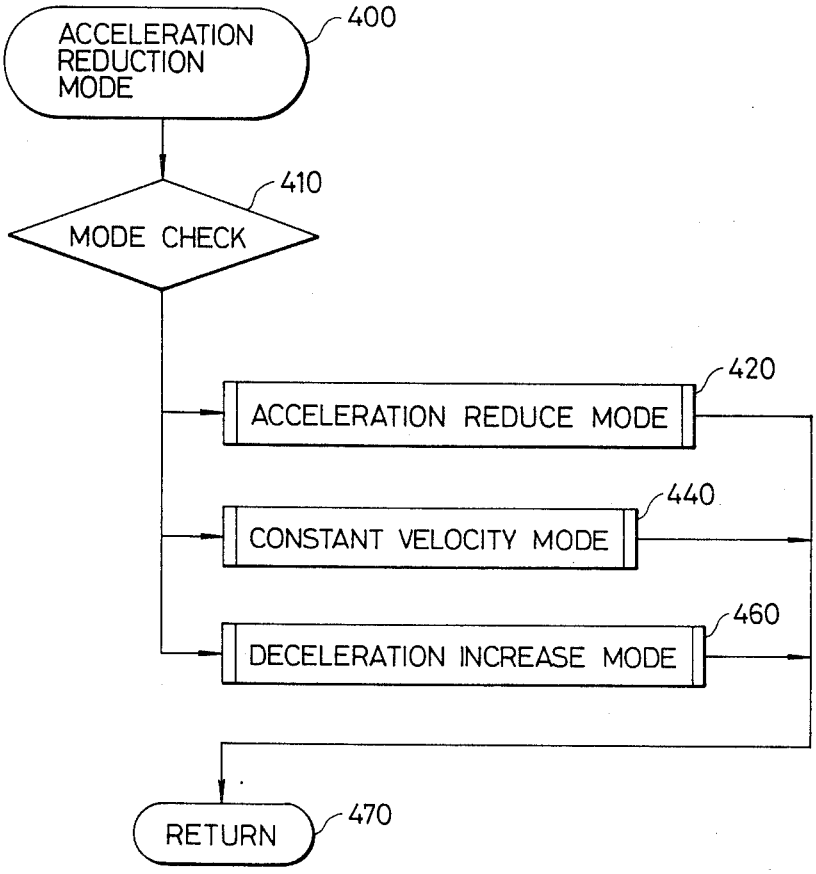

The acceleration reduction mode 400, as shown in FIG. 9, checks the mode at step 410 and performs one of acceleration reduce mode 420, constant velocity travel mode 440 and deceleration increase mode 460 before coming to an end.

The reason for dividing the acceleration reduction mode 400 into three modes is to ensure a smooth transition to the mode of velocity command $V_1$ from the constant deceleration mode.

Figure 10:
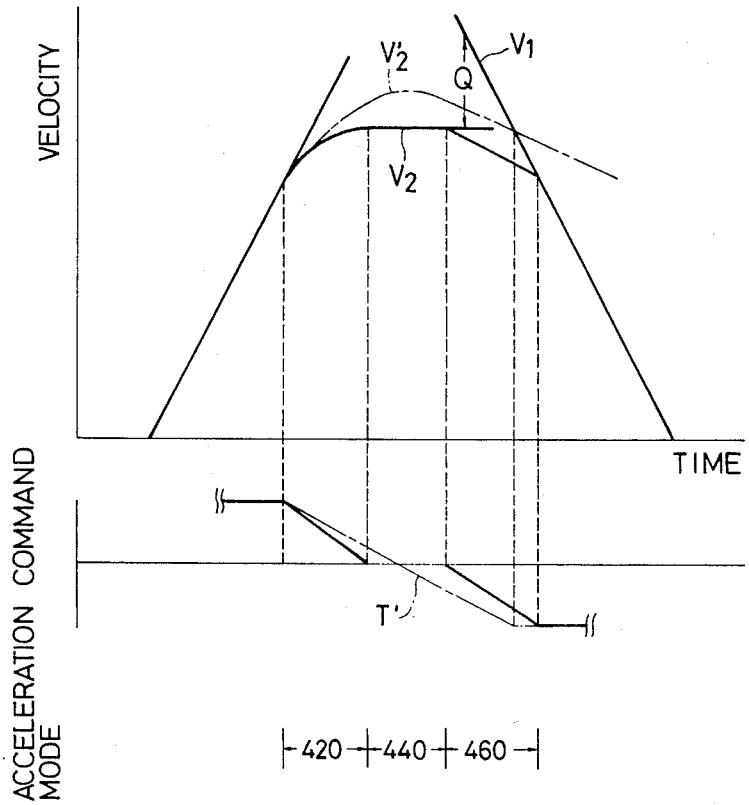

As a method with the acceleration reduction mode 400 not divided, it is possible to generate a current torque command T', as shown in FIG. 10, by adding or subtracting the specified value $\Delta t_0$, at the completion of the constant acceleration mode and make a transition from the constant deceleration mode when the difference between the velocity setting $V_1$ and the elevator velocity $V_2'$ becomes smaller than the specified value Q. While this method has a good effect of heightening the operation efficiency, it is required to change the value Q according to the maximum value of travel velocity $V_2'$ in order to insure a transition to the constant deceleration mode.

Figure 11:
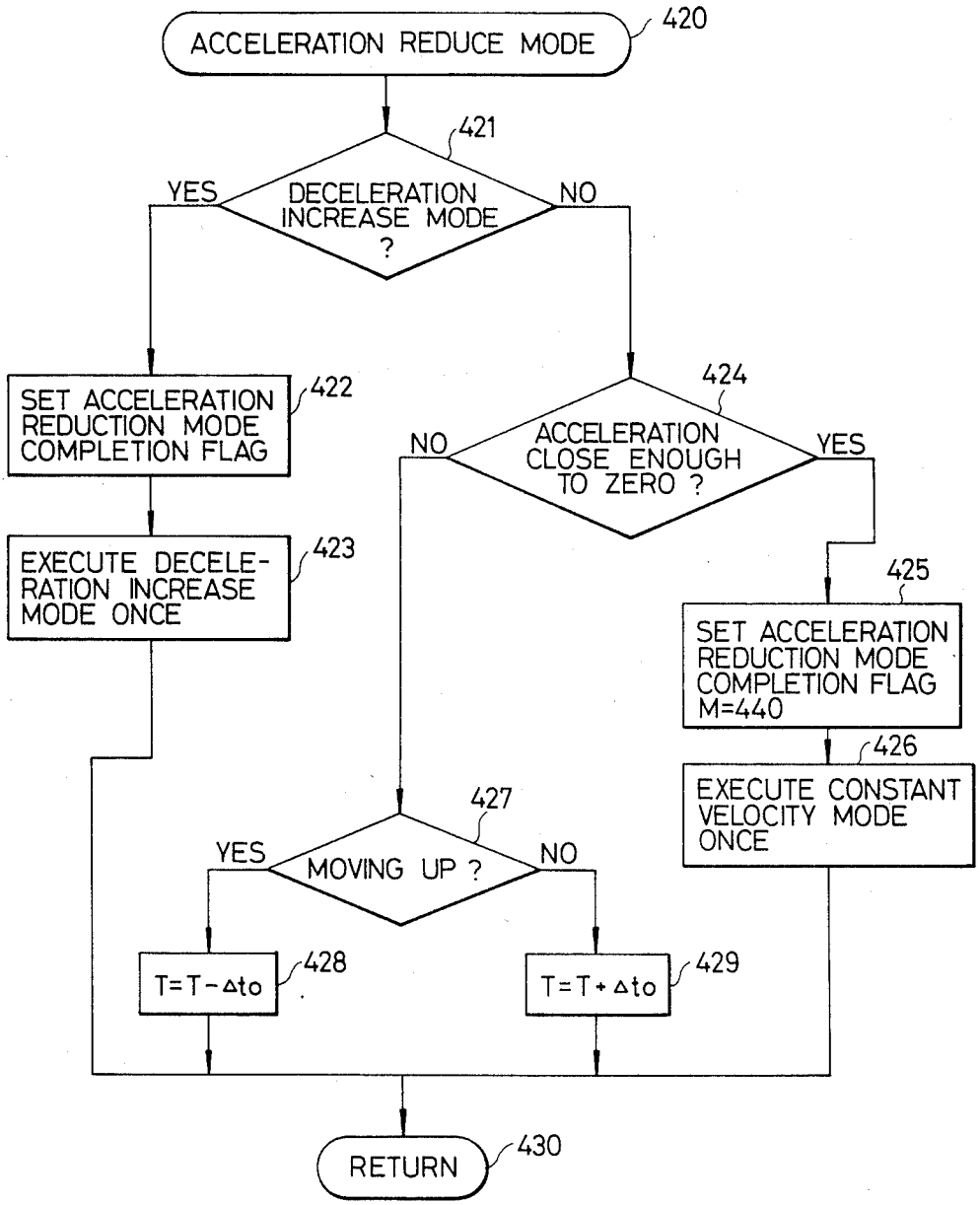

The acceleration reduce mode 420, as shown in FIG. 11, first checks at step 421 whether the current condition is the deceleration increase mode. If so, at step 422 a flag is set indicating the acceleration reduction mode has ended. At the succeeding step 423 the deceleration increase mode which will follow is executed once before bringing the current mode to an end. The transition from the acceleration reduction mode to the deceleration increase mode is effected when the deceleration distance to the floor at which the car will stop is not sufficient for one reason or another. Normally this route is not taken. The decision at step 421 on whether the current condition is the deceleration increase mode is made by checking if the difference between the velocity command $V_1$ and the elevator velocity $V_2$, shown in FIG. 10, is smaller than a specified value $V_9$. When the route not leading to the mode transition is taken, a check is made at step 424 on as to whether the acceleration A is sufficiently close to zero. If so, a step 425 sets a flag indicating the acceleration reduction mode has been completed and at the step 426 the constant velocity travel mode which will follow is executed once before bringing the processing to an end. If the acceleration is not close enough to zero, a check is made at step 427 on as to the direction of travel. When the car is travelling upward, a new torque command T is calculated at step 428 by subtracting a specified value $\Delta t_0$ from the previous torque command T. When the car is moving downward, a current torque command T is obtained at step 429 by adding the previous torque command T and the specified value $\Delta t_0$. Then the acceleration reduction control process comes to an end. The torque command signal generation at steps 428 and 429 are performed using estimation with no feedback.

At steps 428 and 429 it is possible to perform negative feedback controls. That is, the function of the step 428 may be represented as $T=T+\alpha_c-A$ instead of $T=T-\Delta t_0$, and the step 429 as $T=T+\alpha_c+A$. The value $\alpha_c$ is an acceleration command that reduces at a constant rate and must be computed at the first stage of the acceleration reduce mode 420. This method can advantageously be applied to a system where the use of only the estimation control does not give sufficient performance.

Figure 12:
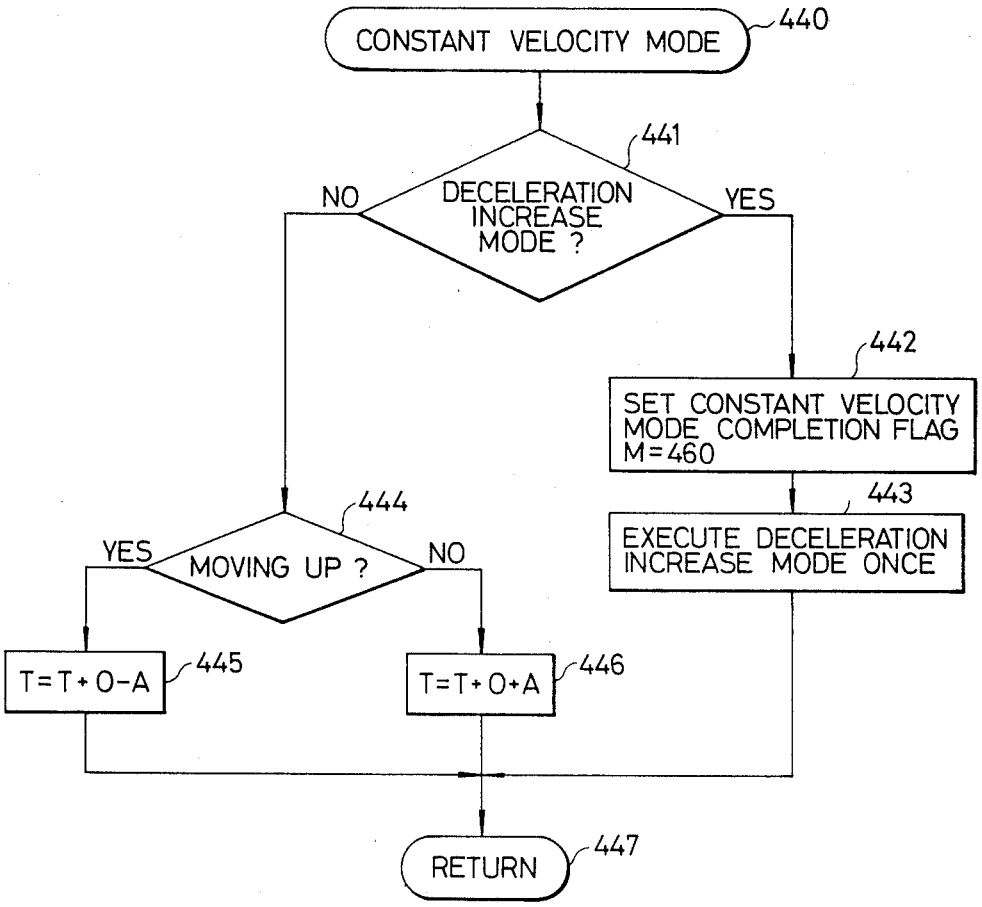

The constant velocity travel mode 440, as shown in FIG. 12, first checks at step 441 whether the current condition leads to the transition to the deceleration increase mode. If so, a step 442 sets a constant velocity travel mode completion flag and a step 443 executes once the deceleration increase mode which will follow. When there is no transition, a check is made at step 444 as to the travel direction. At steps 445 and 446 the torque command T is generated that will cause the acceleration to be zero. Then the constant velocity travel mode 440 comes to an end.

Figure 13:
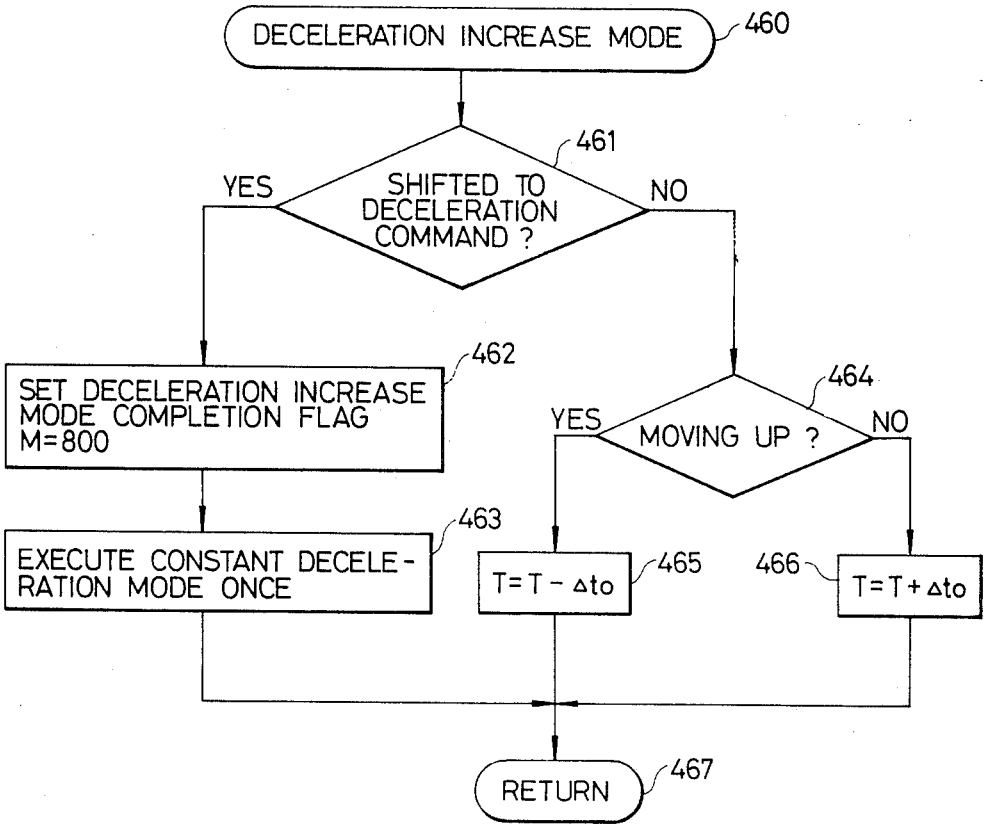

The deceleration increase mode 460, as shown in FIG. 13, checks at step 461 whether the current condition has reached a point leading to the transition to the constant deceleration mode. If so, the step 462 sets a flag indicating the deceleration increase mode has been completed. And at 463 the constant deceleration mode that will follow is executed once, before brining an end to the current mode. If the transition point has not yet been reached, a step 464 checks the direction of travel. Then a new torque command is obtained by subtracting the specified value $\Delta t_0$ from the previous torque command T when the car is moving up and by adding the specified value $\Delta t_0$ to the previous torque command T when the car is descending, thereby performing the deceleration increase control with a specified rate of change of deceleration. The torque command signal generation is done by the estimation control like the acceleration reduction mode and the acceleration start mode.

Figure 14:
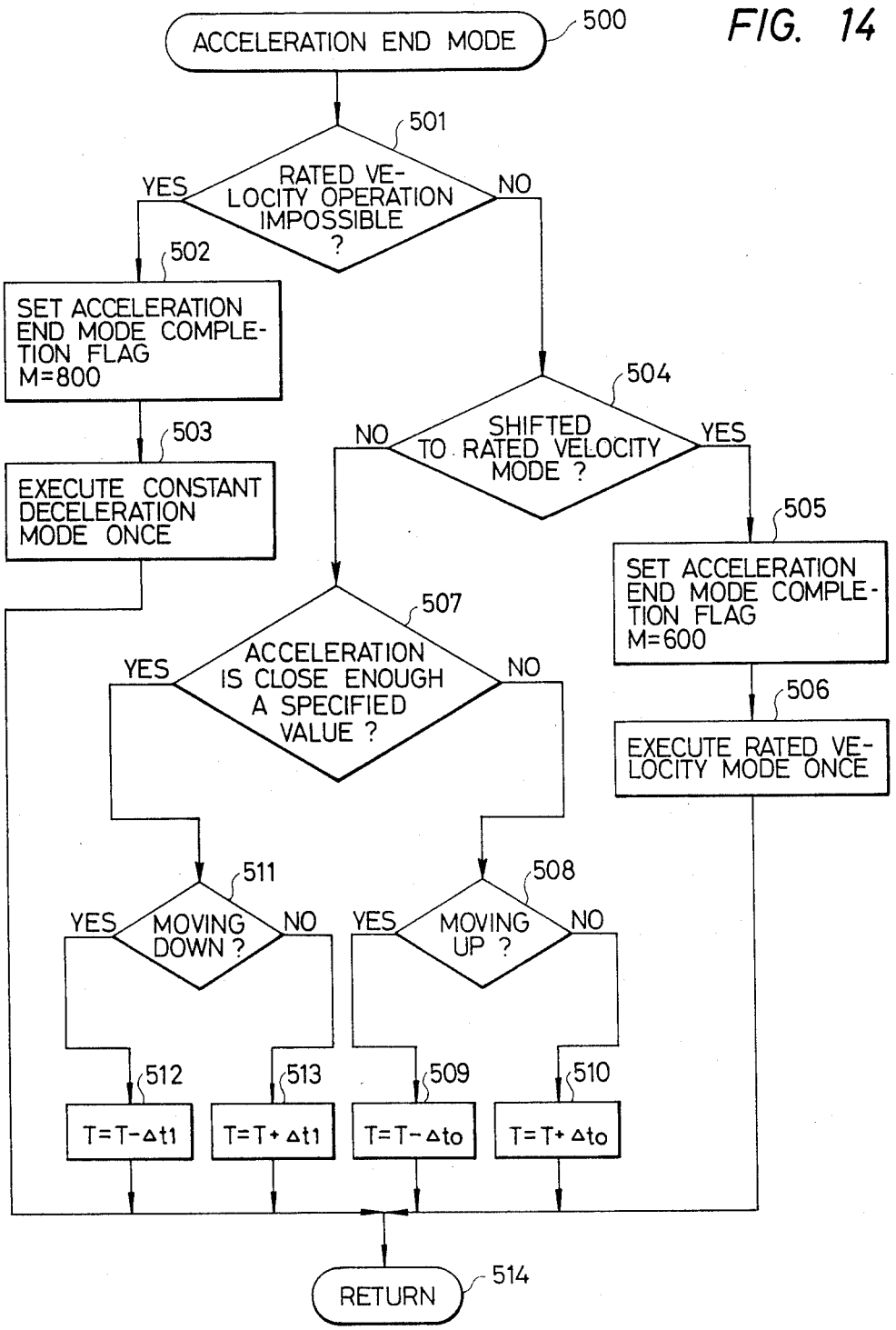

The acceleration ending mode 500, as shown in FIG. 14, first checks at step 501 whether the travel at the rated speed is impossible. If so, the step 502 sets a flag indicating the acceleration ending mode has been completed, and at step 503 the constant deceleration mode is executed once. Then the current mode comes to an end. The decision on whether the travel at rated velocity is impossible or not is made by checking if the difference between the velocity command $V_1$ and the elevator velocity $V_2$ is smaller than a specified value $V_3$. If the travel at the rated speed is found possible, the step 504 checks whether the point of transition to the rated speed is reached. If the transition point has been reached, the step 505 sets a flag indicating that the acceleration ending mode has been completed. At step 506 the rated speed travel mode is executed once. If the transition point is not reached, a check is made at step 507 as to whether the acceleration A is close enough to a specified value. If the absolute value of the acceleration A is greater than a specified value, steps 508 to 510 will produce a gradually decreasing torque command. Depending on whether the absolute value of the acceleration A is greater or smaller than a specified value, a gradually decreasing torque command is produced at steps 508 to 510 or steps 511 to 513 to control the elevator. The increments and decrements $\Delta t_0$ and $\Delta t_1$ have the relation such that $t_0 \Delta t_1$. Because of this relationship, as the acceleration A approaches zero, the rate of change of acceleration is made more moderate so that passengers may feel no shock. It is also possible to modify the steps 427 to 429 of the acceleration reduction mode as shown in FIG. 11 like the steps 507 to 513 of the acceleration ending mode.

Figure 15:
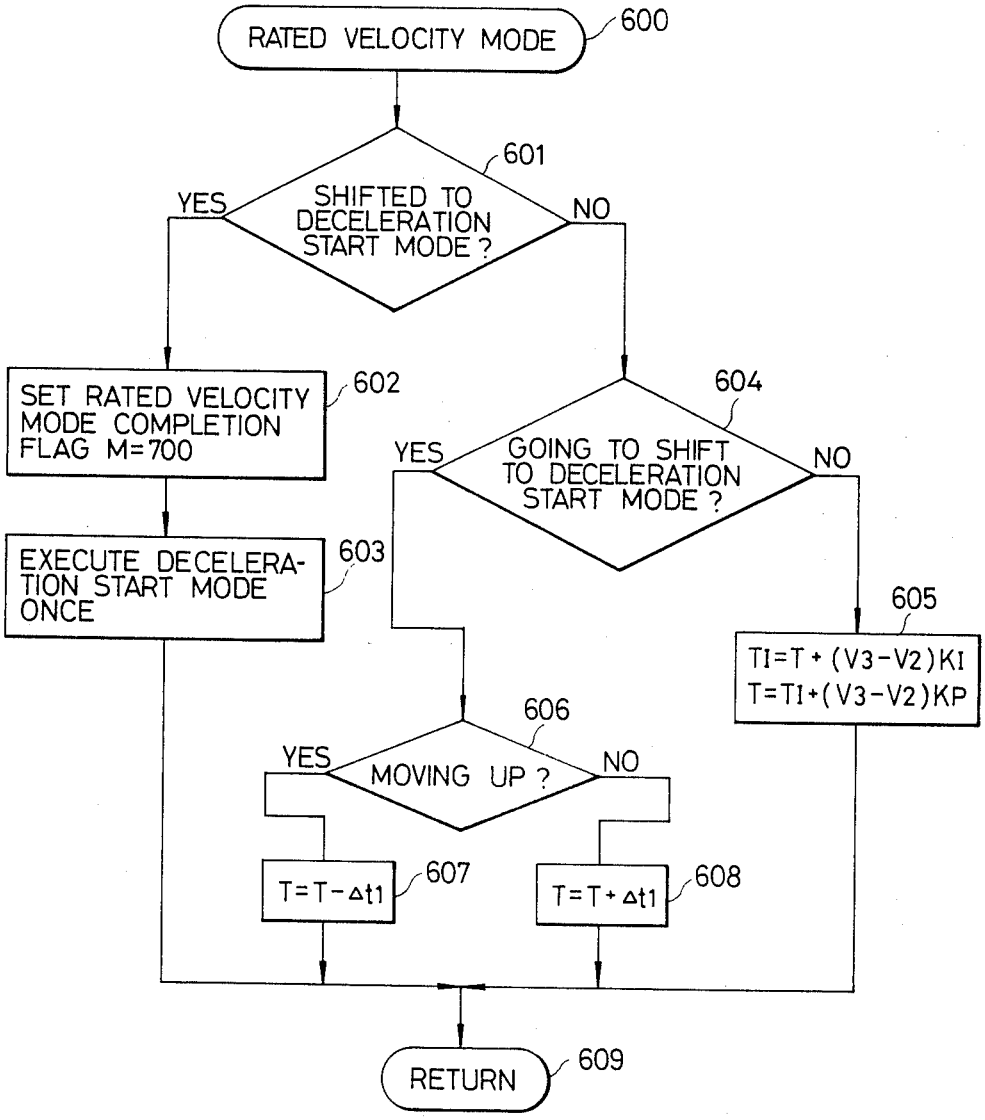

The rated velocity travel mode 600, as shown in FIG. 15, checks at step 601 whether the point of transition to the deceleration start mode has been reached. If so, the step 602 sets a flag indicating the rated travel mode has been completed, and at step 603 the deceleration start mode is executed once, after which the current mode is brought to an end. The decision as to whether the point of transition has been reached is made by checking to see if the difference between the velocity command $V_1$ and the elevator velocity $V_2$ becomes smaller than a specified value $V_7$. When the transition point has not yet been reached, the step 604 checks to see if the current condition is immediately before the transition point. If the transition point is not close enough, the step 605 produces the torque command that will make the elevator speed equal to the rated velocity.

At step 605 the value of $T_I$ is obtained by multiplying the difference between the rated velocity $V_3$ and the elevator velocity $V_2$ with the integral grain $K_I$ and by adding the previous torque command T to this result. Next, the difference between the rated velocity $V_3$ and the elevator velocity $V_2$ is multiplied by the proportional gain $K_P$ and the value of result is added with the $T_I$ to obtain the torque command T. In this way the elevator velocity V2 can be controlled by the proportional plus integral control action so that it will equal the rated velocity $V_3$. If the point of transition to the decelerating start mode is close enough, the steps 607 and 608 gradually increase the deceleration before fully activating the decelerating start mode. As with $\Delta t_1$ shown in FIG. 14, the deceleration increment $\Delta t_1$ used at these steps is set considerably smaller than $\Delta t_0$ to obtain the moderate rate of change of deceleration. It is of course possible to omit the steps 606, 607 and 608. Unlike the constant velocity travel mode shown in FIG. 12, the rated velocity travel mode 600 requires the elevator velocity $V_2$ to be controlled so that it will not exceed the rated velocity $V_3$. This in turn makes necessary the processing of step 605 instead of steps 445 and 446.

Figure 16:
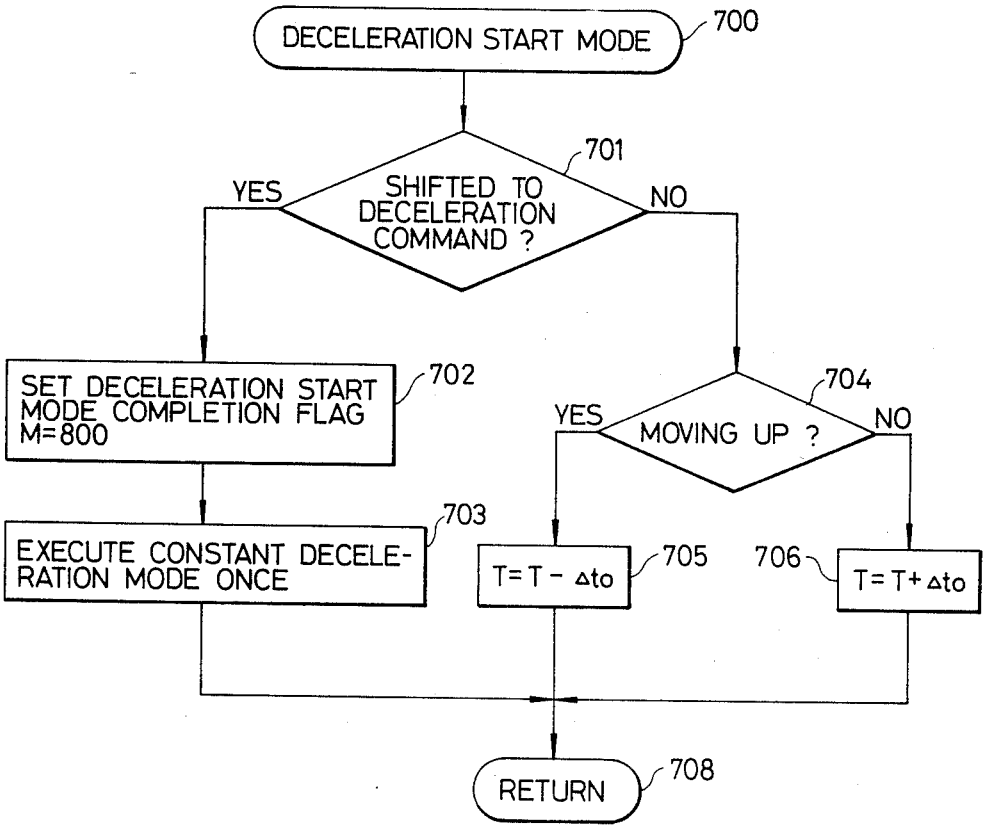

The deceleration start mode 700, as shown in FIG. 16, first checks at step 701 whether the point of transition to the deceleration command is reached. If so, a flag is set at step 702 indicating the completion of the deceleration start mode and at step 703 the constant deceleration mode is executed once before bringing the current mode to an end. The decision on whether the mode transition point has been reached or not is made by checking to see if the velocity command $V_1$ has become smaller than the elevator velocity $V_2$. If it is decided that the transition point has not yet reached, the step 704 checks the direction of travel. If the elevator is moving up, the current torque command T is obtained by subtracting the specified value $\Delta t_0$ from the previous torque command T. If the elevator is moving down, it is obtained by adding the specified value $\Delta t_0$ to the previous torque command T. In this way the rate of change of deceleration is limited to a specified value.

Figure 17:
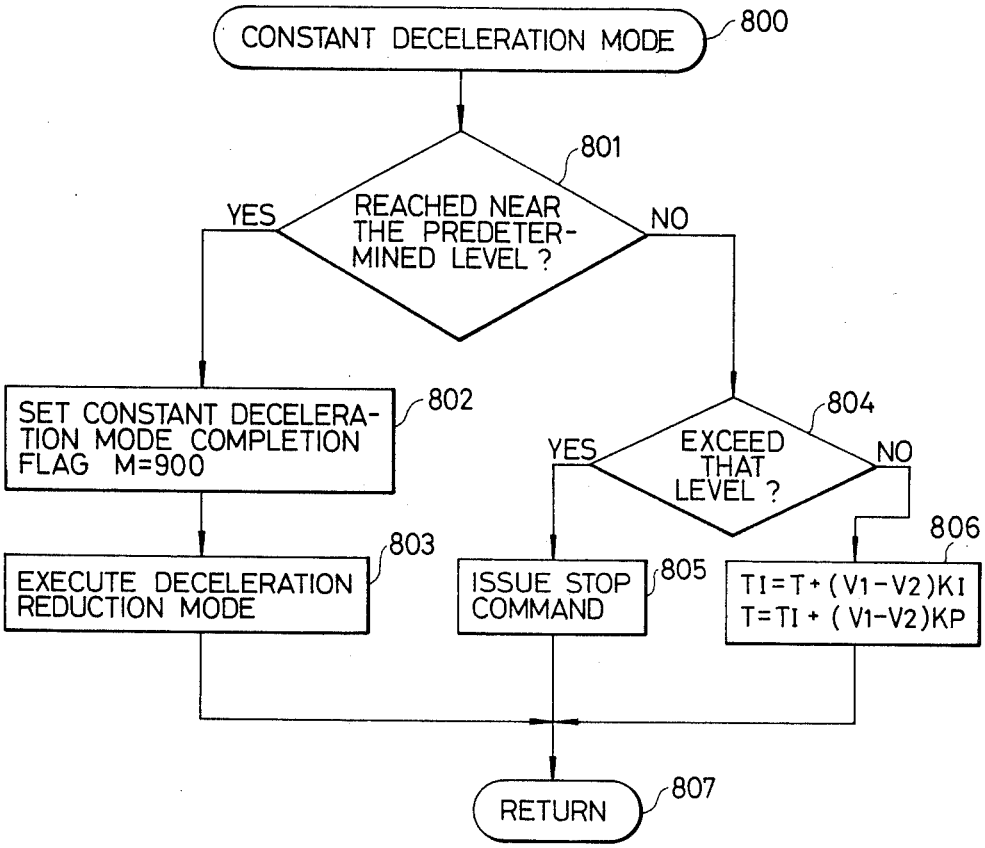

The constant deceleration mode 800, as shown in FIG. 17, performance checking at step 801 to see whether the car has reached a certain range ($2 \cdot \Delta L$) short of the destination floor level. If so, at step 802 a constant deceleration mode completion flag is set and at step 803 the deceleration reduction mode is executed once, before bringing the current mode to an end. The decision made at the step 801 depends on whether the distance L between the car and the destination floor has reached the point X or come within the range $2 \cdot \Delta L$. If L is greater than $2 \cdot \Delta L$, a step 804 checks whether the car has passed the le level of the destination floor. If so, a step 805 issues an elevator stop command and if not, a step 806 performs torque control to provide a constant deceleration. At the step 806, $T_I$ is obtained by multiplying the difference between the velocity command $V_1$ and the elevator velocity $V_2$ with an integral gain $k_I$ and adding the result to the previous torque command T. Next, the current torque command T is obtained by multiplying the difference between the velocity command $V_1$ and the elevator velocity $V_2$ with a proportional gain $K_P$ and adding the result to the value of $T_I$. This processing gives a proportional and integral torque control involving the distance as parameter. The velocity command $V_1$ is determined from the square root function ($V_1 = \sqrt{2 \cdot A_1 \cdot (L - \Delta L)}$). The second velocity command $V_1$, beyond the point X will be explained together with the deceleration reduction mode. The processing at the step 805 is performed by substituting zero into $V_1$ of the step 806.

Figure 19:
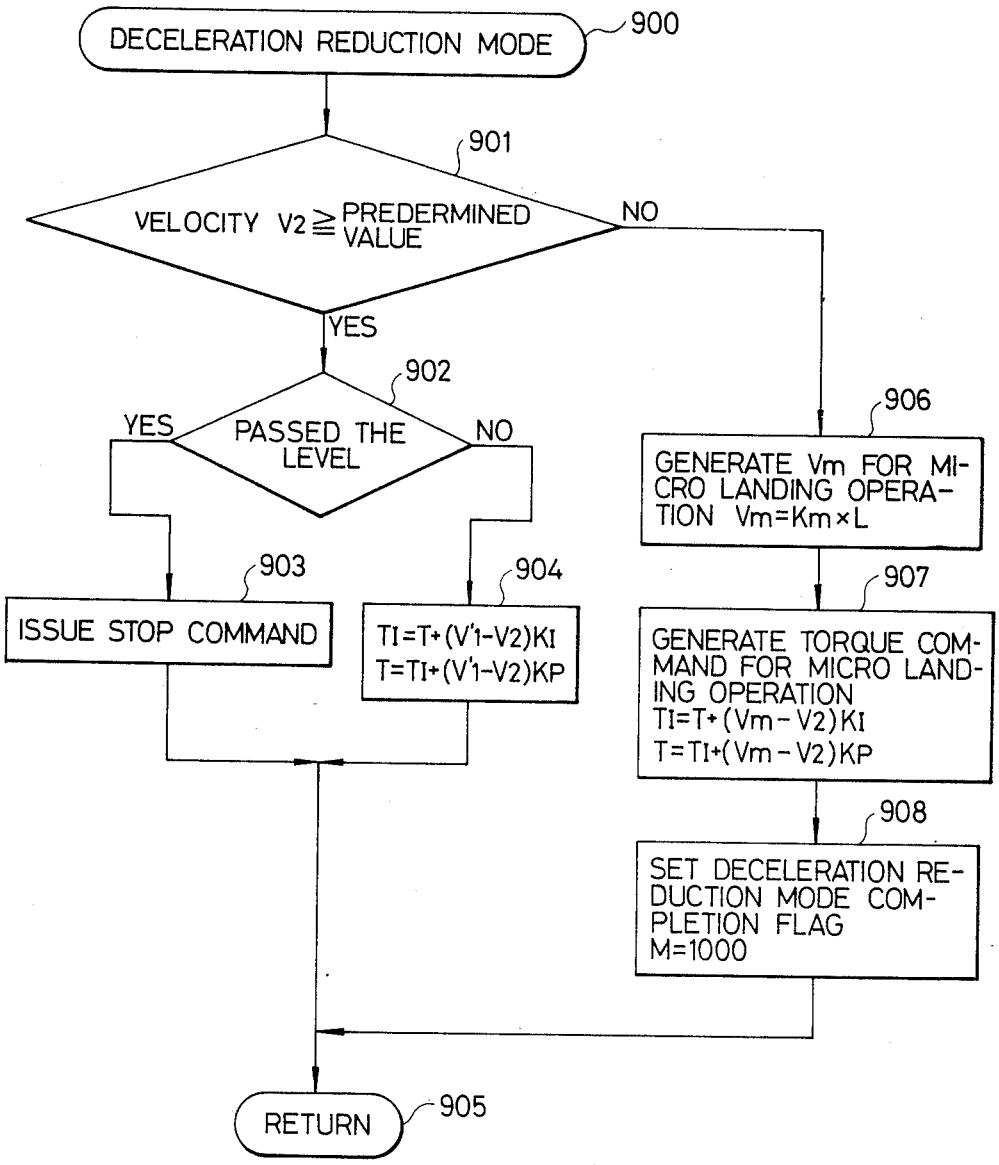

The deceleration reduction mode 900, as shown in FIG. 19, checks at step 901 whether the elevator velocity $V_2$ is greater than a specified value. If so, a check is made at step 902 to see if the elevator car has passed the destination floor level. When the car is found to have passed that level the step 903 issues the stop command similar to that generated at the step 805. If not, the step 904 performs torque control that provides a constant rate of change of deceleration. Apparently similar to the step 806, the step 904 in fact differs from the step 806 in that the second velocity command $V_1'$ is used instead of the velocity command $V_1$.

Figure 18A:
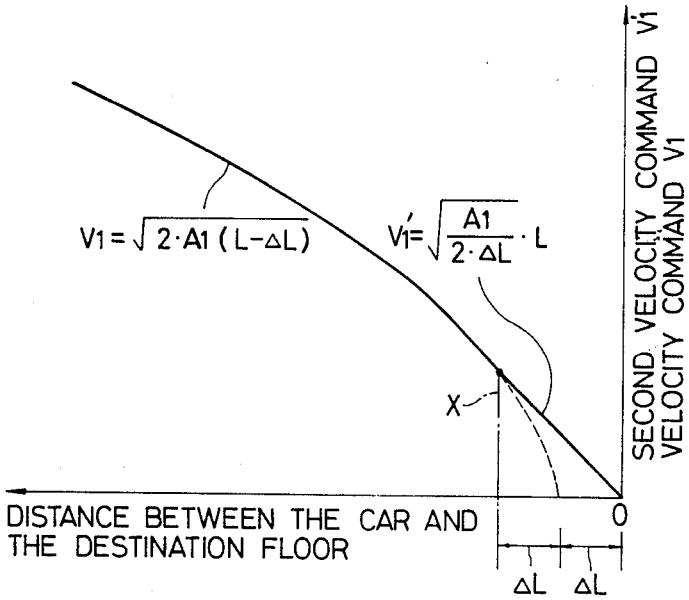
Figure 18B:
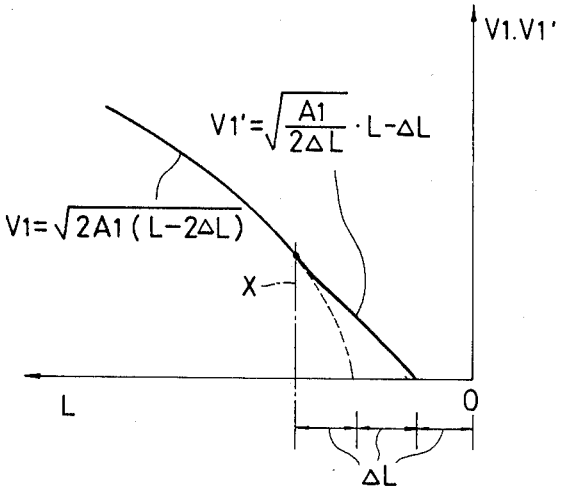

While the second velocity command $V_1'$ shown in FIGS. 18(*a*) and (*b*) is expressed by an equation of the first degree with respect to distance L, it may also be possible to express it by an equation of a higher degree to help provide a smoother motion of the car just before it stops at the floor.

Further, by making the second velocity command $V_1'$ become zero a small distance short of the destination floor, as shown in FIG. 18(*b*), to provide a numb band ($\Delta L$ in the figure) in the system which have a delay in generating the torque of motor, it is possible to prevent the elevator from rebounding when it stops.

Further even in the system where there is a delay after the issuing of a torque command signal before a corresponding torque is produced, it is possible to prevent the car from rebounding when it stops by making the second velocity command $V_1'$ equal to zero at a point a small distance short of the destination floor to provide a numb region ($\Delta L$ in the figure).

On the other hand, when the elevator velocity $V_2$ is smaller than the specified value, the step 906 determines the velocity command Vm for microlanding operation according to the distance L to the destination floor. A step 907 produces a first torque command for the microprocessor operation so that the remaining distance L will be zero. At the next step 908 a flag is set indicating the completion of the decelerating reduction mode, thus ending the current mode.

Figure 20:
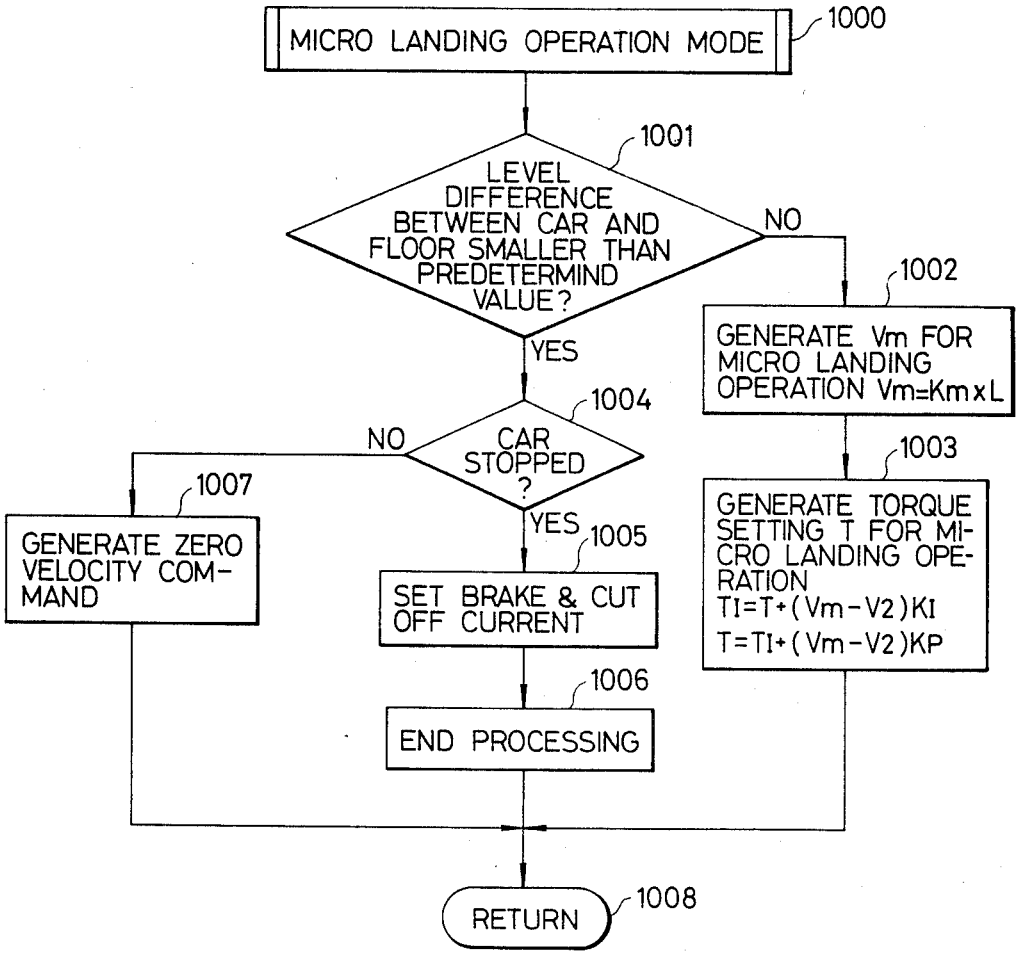

The microlanding operation mode, as shown in FIG. 20, first checks at step 1001 whether the car has come within a range sufficiently close to the position at which it is intended to stop. If not, the step 1002 determines the velocity command Vm for microlanding operation and the next step 1003 generates the torque command for microlanding operation as the microlanding operation continues. If the car is found to have come sufficiently close to the destination position, a check is made at step 1004 to see if the elevator velocity is zero. If so, the step 1005 sets a brake and cuts off the current. This is followed by the step 1006 where a flag indicating the completion of the microlanding operation mode is set to effect a transition to the elevator operation ending mode. When at step 1004 the car is found to be still moving, the step 1007 produces a torque that will cause the elevator velocity $V_2$ to become zero because the application of a brake while the car is still moving will cause a shock.

Figure 21:
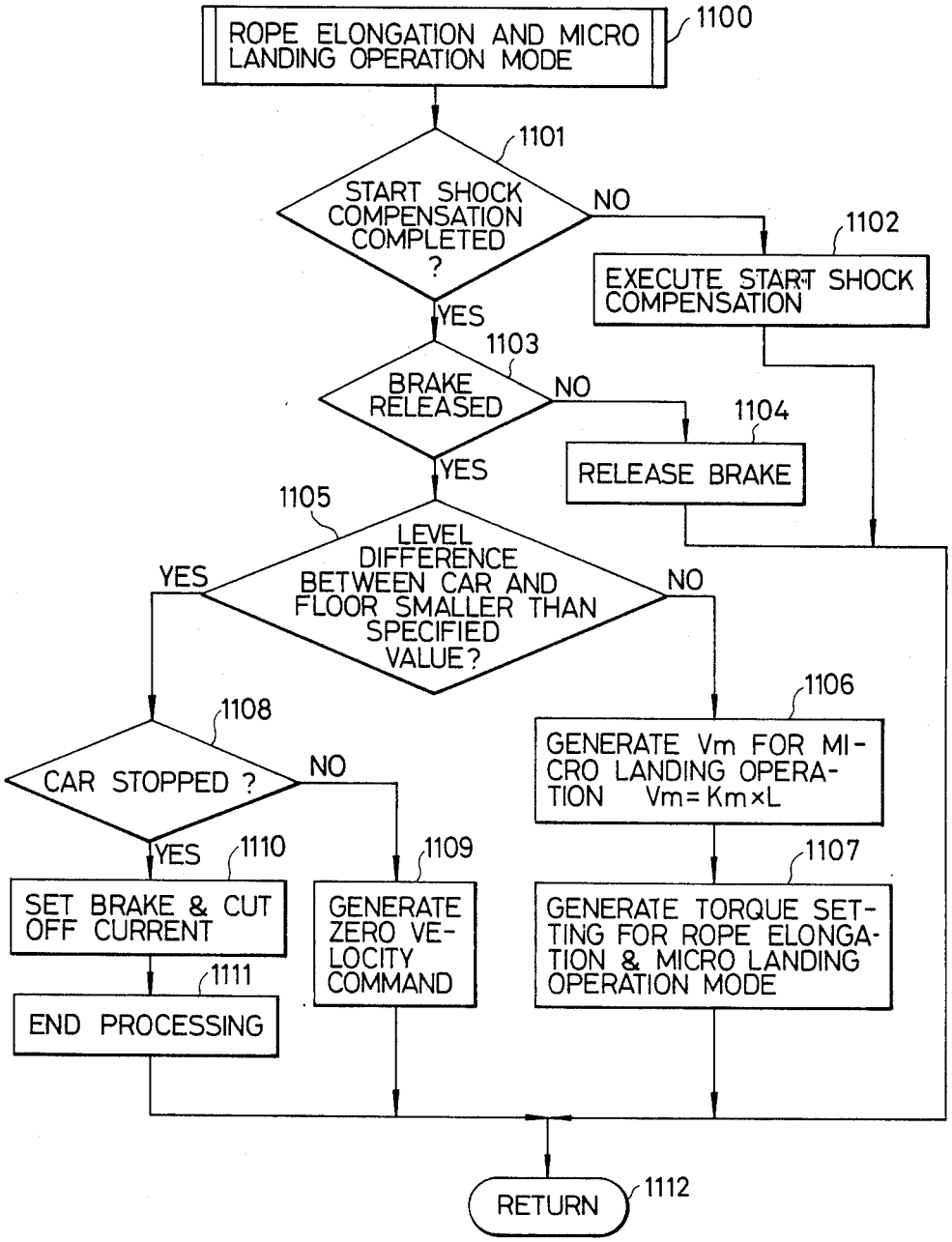

FIG. 21 shows the program chart for the rope elongation and microlanding operation mode. This mode is not run sequentially as are the modes 100 through 1000. That is, this mode is commenced when the difference in level between the car and the floor at which the car is stopped increases with the brake applied. This may occur when a large number of passengers get into or out from the car. The level difference between the car and the floor is not shown here. But it is checked at predetermined intervals by another program and when it is found necessary to perform this mode, the check program sets the mode check flag "M" at 1100.

The rope elongation and microlanding operation mode 1100 checks at step 1101 to see whether the start shock compensation has been executed. If not, the start shock compensation is performed at step 1102 to prevent the start shock. If the start shock compensation is found to have been executed, a check is made at the next step 1103 on whether the brake is released. If the brake is still activated the step 1104 releases the brake. If released, the step 1105 checks to see whether the pulse count representing the level difference between the car and the floor is smaller than a specified value. When the pulse count is found to be not smaller than a specified value, the succeeding step 1106 produces the velocity command Vm for microlanding operation and the step 1107 generates a torque command for the rope elongation and microlanding operation. If the car is found sufficiently close to the destination floor, the step 1108 checks to see whether the elevator car has stopped. The application of the brake with the car not halted will cause a shock to the passengers. Hence, if the car is found still moving, the step 1109 reduces the elevator speed to zero before applying a brake. If the elevator car is found halted, the step 1110 applies the brake and off the current, after which the program executes the mode completion processing.

While in the above embodiment the level difference between the car and the floor during the microlanding operation is determined from the pulse counts from the pulse generator 24 and the floor level table stored in the ROM, it is also possible to detect the difference in analog signal between a differential transformer mounted on the car and a barrier plate installed at each floor and to then convert the signal into a digital signal which is then taken into the microprocessor. The latter method will also provide the same microlanding operation and the devices for this purpose are of common knowledge, so the explanation on them is omitted here.

With the above embodiment of this invention, as described in the foregoing, the constantly changing, timely torque command is provided for the elevator car velocity control, acceleration control and rate of change of acceleration control, so that a smooth motion of elevator car can be obtained from the moment of starting to the moment of stopping.

Further, with this invention the torque command is calculated each time the task of each mode is executed. This method is completely different from the method in which a plurality of predetermined velocity patterns or acceleration patterns are stored, and therefore has the advantage of not only obviating the use of a ROM for prestoring these patterns but also enabling a smooth transition from acceleration to deceleration at maximum possible speed over the intermediate travel range.

In addition, since under the constant acceleration mode the control system automatically operates to make the torque command not greater than the specified optimum value $A_0$, it is not necessary to check and adjust the saturation relation with the power unit for each elevator which is illustrated in FIG. 7.

Furthermore, for the elevator which is supplied from the independent power plant, various methods are proposed to quicken the return of the elevator cars to the base floor by reducing the acceleration and deceleration of the car in view of the limited capacity of the power source. However, with the conventional system using the velocity pattern or acceleration pattern storage method or with the system that controls the elevator car by performing operation on the velocity pattern, it is difficult to change the acceleration or deceleration. But this can easily be attained with this embodiment as by halving the specified acceleration $A_0$ and $A_1$ when a flag is set indicating that the elevator is being supplied from the independent power plant.

What we claim is:

1. In an elevator system consisting of an elevator car that services a plurality of floors, a rope attached to the car at one end and a counterweight at the other, and a motor for driving the elevator car through the rope; an elevator controller comprising means for generating an acceleration command for the elevator car and a means for directly controlling the motor according to the acceleration command.

2. An elevator controller as defined in claim 1, wherein the means for generating the acceleration command comprises means for producing the acceleration command signal at least when the car is being accelerated.

3. An elevator controller as defined in claim 2, wherein said acceleration command generating means comprises means for determining the initial value of the acceleration command according to the unbalance torque between the car and the counterweight.

4. An elevator controller as defined in claim 2, wherein the acceleration command generating means comprises means for generating an acceleration command on the basis of a gradually increasing acceleration start mode, a constant acceleration mode and a gradually decreasing acceleration reduction mode.

5. An elevator controller as defined in claim 4, wherein the acceleration start mode has an initial value which offsets the unbalance torque between the car and the counterweight and generates a torque command with a desired rate of change of acceleration which is obtained by adding or subtacting a specified value to or from the initial value at certain intervals.

6. An elevator controller as defined in claim 4, wherein a transition is made from the acceleration start mode to the constant acceleration mode on the condition that the acceleration of the car or the acceleration command has reached a specified value.

7. An elevator controller as defined in claim 4, wherein a transition is made from the constant acceleration mode to the acceleration reduction mode on the condition that the difference between the actual velocity of the car and the desired velocity has become smaller than a specified value.

8. An elevator controller as defined in claim 1, wherein the means for generating the acceleration command comprises means for producing a gradually increasing deceleration command at least near the point where the deceleration of the car is to be started.

9. An elevator controller as defined in claim 2, wherein the acceleration command generating means comprises means for producing, following the acceleration command produced during the acceleration operation, a constant acceleration command and thereafter a gradually increasing deceleration command.

10. In an elevator system consisting of an elevator car servicing a plurality of floors, a rope attached to the car at one end and a counterweight at the other, a motor for driving the car through the rope, and a means for detecting the actual velocity of the car; an elevator controller comprising means for producing an acceleration command signal which determines the positive or negative acceleration of the car; means for producing a velocity command signal which determines the velocity of the car; and means for directly controlling the motor according to the acceleration command in a first range of operation and according to the difference between the velocity command and the actual velocity in a second range of operation.

11. An elevator controller as defined in claim 10, wherein the first range of operation includes at least a car acceleration range and the second range of operation includes at least a car decelerating range.

12. An elevator controller as defined in claim 11, wherein the car deceleration range is controlled on the condition that the actual velocity of the car has exceeded the velocity command.

13. An elevator controller as defined in claim 10, wherein the second range of operation includes a rated velocity range and the first range of operation includes a deceleration start range which provides a transition from the rated velocity to the deceleration operation.

14. An elevator controller as defined in claim 13, wherein a transition is made from the second range of operation to the first range of operation on the condition that the difference between the actual velocity and the velocity command has become smaller than a specified value.

15. An elevator controller as defined in claim 10, wherein the first range of operation includes a car acceleration range, the second range of operation includes a rated travel range, and a transition from the first to the second range is effected on the condition that the difference between the actual car velocity and the rated velocity has become smaller than a specified value.

16. An elevator controller as defined in claim 10, wherein the first range of operation ranges from the acceleration range with its velocity lower than the rated velocity to the deceleration start range and the second range of operation includes the car deceleration range.

17. An elevator controller as defined in claim 10, wherein as the transition is effected from the first to the second range of operation, the second range of operation is controlled by adding or subtracting the velocity difference to or from the initial value of the torque command which was generated at the completion of the first range of operation.

18. An elevator controller as defined in claim 11, wherein the velocity command issued during deceleration is made to decrease with a corresponding reduction in the relative distance between the car and the destination floor.

* * * * *